United States Patent [19]

Ray et al.

[11] Patent Number: 4,790,481

[45] Date of Patent: Dec. 13, 1988

[54] POP-UP IRRIGATION SPRINKLER

[75] Inventors: Charles A. Ray, Stateline; Billy J. Hobbs, Jr., Gardnerville, both of Nev.

[73] Assignee: GardenAmerica Corporation, Carson City, Nev.

[21] Appl. No.: 140,586

[22] Filed: Jan. 4, 1987

[51] Int. Cl.[4] ..... B05B 15/10

[52] U.S. Cl. ..... 239/204; 239/590; 239/600

[58] Field of Search ..... 239/DIG. 23, 200–206, 239/590, 590.3, 590.5, 575, 600

[56] References Cited

U.S. PATENT DOCUMENTS

| | | | |
|---|---|---|---|
| 460,368 | 9/1891 | Splittstoser | 239/DIG. 23 |
| 1,203,542 | 10/1926 | Hanley | 239/204 X |
| 2,973,905 | 3/1961 | Ackley | 239/575 X |
| 3,273,085 | 9/1966 | Hall | 239/600 X |
| 3,666,181 | 5/1972 | Healy | 239/206 |
| 3,731,954 | 5/1973 | Haglund | 285/12 |
| 4,003,520 | 1/1977 | Bailey | 239/205 |
| 4,078,726 | 3/1978 | Walto | 239/590 X |

*Primary Examiner*—Andres Kashnikow
*Assistant Examiner*—Kevin P. Weldon
*Attorney, Agent, or Firm*—Keith D. Beecher

[57] ABSTRACT

A pop-up irrigation sprinkler which includes a riser which is forced by water pressure up out of a body through a cover attached to the top of the body. The riser is normally held in a retracted position by a coil spring. A nozzle is removably attached to the upper end of the riser. An adjustable screw is threaded into the nozzle to adjust the flow rate of water through the nozzle to control both the flow rate and the radius of the watering pattern. An elongated filter is removably mounted on the inner end of the nozzle, and the filter extends down into the riser. The filter has a head having an orifice therein and which defines a conical seat for the screw. An adapter is interposed between the nozzle and the riser and serves to trap the head of the filter to enable different types of nozzles from different manufacturers to be used in the sprinkler.

8 Claims, 3 Drawing Sheets

POP-UP IRRIGATION SPRINKLER

BACKGROUND OF THE INVENTION

The pop-up irrigation sprinkler of the present invention is of the same general type described in U.S. Pat. No. 4,220,283. Such pop-up sprinklers are generally well known to the art, and they are presently being manufactured by a number of different manufacturers.

The pop-up irrigation sprinkler referred to above includes a cylindrical body and a tubular riser positioned coaxially within the body. A nozzle is mounted on the upper end of the riser. The riser is normally spring-biased to a retracted position within the body. However, when water under pressure is introduced into the lower end of the body, the riser moves upwardly and extends through a cover at the upper end of the body to perform its sprinkling function.

The irrigation sprinklers described in the preceding paragraph usually include a filter for straining out particulate matter contained in the water. In the sprinkler of the invention as will be described, the filter is positioned at the top of the riser adjacent to the nozzle, and it is removably retained by the nozzle. With such an assembly, when the nozzle is removed from the riser, the filter also is removed since it is attached to the nozzle.

It is usual practice during the installation of a sprinkler system, and as a final step, for the installer to remove all the nozzles from the various sprinklers of the system, and to cycle pressurized water into the system. This water serves to flush out any dirt that might have accumulated in the pipes of the system when the system was being installed.

It is important that the filters be removed with the nozzles at this time, because if the filters are left in the sprinklers while the system is being flushed out, they will be blown out of the sprinklers and may be lost. The prior art sprinklers, for the most part, include filters which fit loosely into the assemblies, and they must be picked out with a screwdriver, wire or awl, after the nozzles have been removed, which is a tedious process, and also which has a tendency to damage the filters.

This necessity is obviated by the sprinklers of the present invention, since the filters come out with the nozzles when the nozzles are removed.

Another feature of the invention is to provide a sprinkler which includes an adapter fitted between the nozzle and the top of the riser. This adapter enables different types of nozzles manufactured by different manufacturers, and which may have different thread types and different lengths, to be used in the sprinkler. In all cases, as will be described, the adapter serves to trap the filter onto the nozzle.

Other features and advantages of the improved irrigation sprinkler of the present invention will become apparent from the following disclosure.

DETAILED DESCRIPTION OF THE ILLUSTRATED EMBODIMENT

Figure 1:
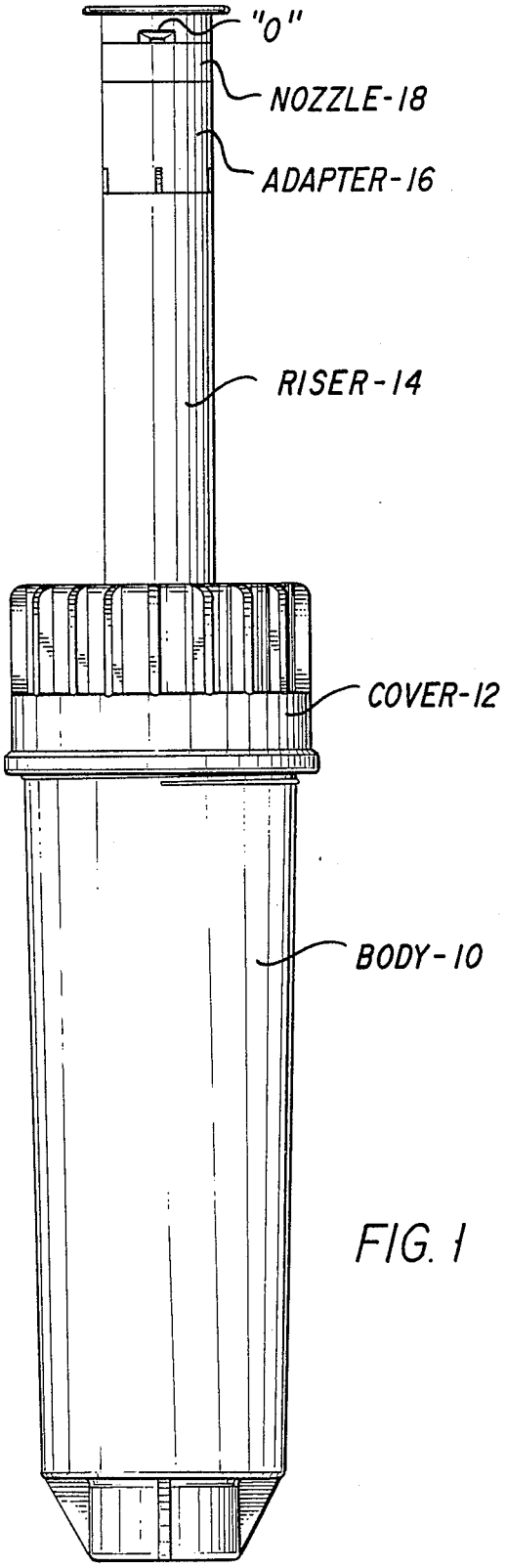
FIG. 1 is a side elevational view showing an irrigation sprinkler constructed in accordance with the concepts of the present invention, and of the type described above, with its riser forced up through the cover of the body of the sprinkler, and in position to perform its sprinkling operation.
Figure 2:
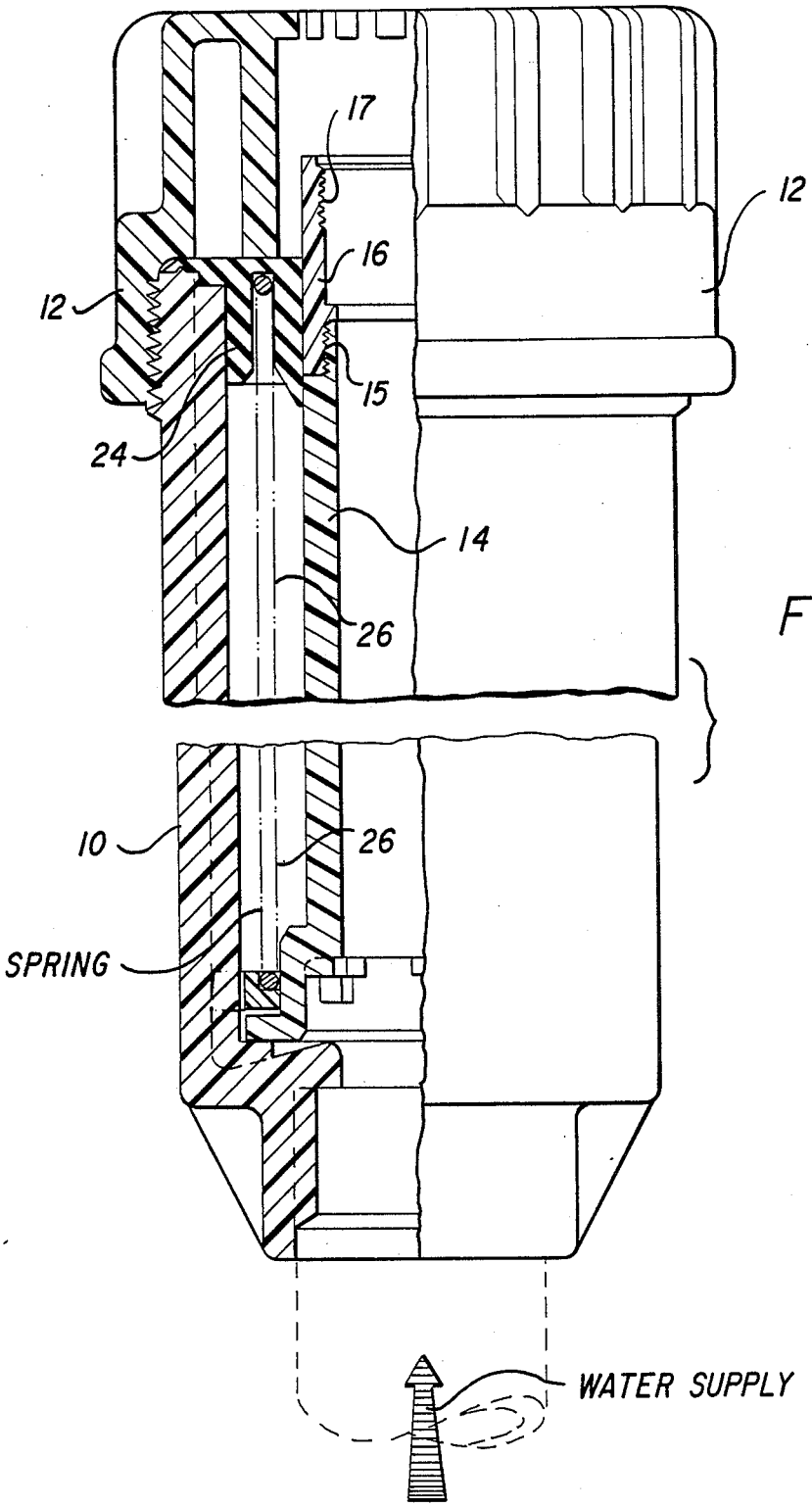
FIG. 2 is a side elevation of the sprinkler of FIG. 1, partly in section, with the nozzle removed, and with the riser in its retracted position within the body of the sprinkler.

The irrigation sprinkler, as shown in FIGS. 1 and 2, includes a cylindrical body 10 having a cover 12 threaded to its upper end, and containing a riser 14. A tubular adapter 16 is threaded to the top of riser 14, and a nozzle 18 is, in turn, threaded to the upper end of the adapter, as best shown in FIG. 1. Nozzle 18 is equipped with an orifice "O" through which water is emitted when the riser is in the illustrated position of FIG. 1, the riser being forced to its extended position of FIG. 1 by the introduction of water from a pressurized source into the lower end of body 10.

As shown in FIG. 2, an annular seal 24 is interposed between the top of the body 10 and cover 12, and the seal bears against the outer periphery of adapter 16 and riser 14, as the riser moves by water pressure against the force of a spring 26 from the position shown in FIG. 2 to the position shown in FIG. 1. The seal is configured to maintain a sealing contact with the and riser 14 when the riser is in the position of FIG. 1.

Figure 5:
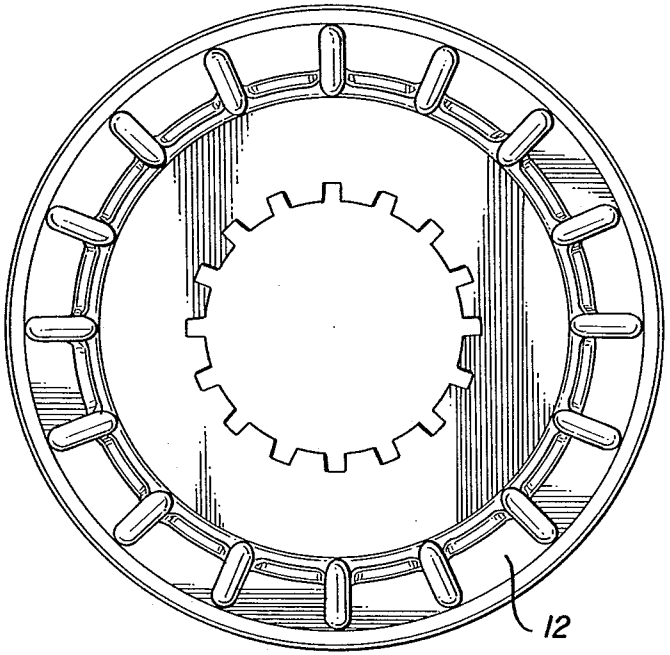
FIG. 5 is a top plan view of a cover which is attached to the top of the body of the irrigation sprinkler.

Cover 12 has a central aperture, as shown in FIG. 5, through which the riser 14 extends when it moves from its position of FIG. 2 to its position of FIG. 1. The inner margin of the cover adjacent to the aperture is serrated, as shown in FIG. 5 to prevent relatively large particles from entering the assembly between the cover and the riser, which would have a tendency to jam the riser.

Figure 3:
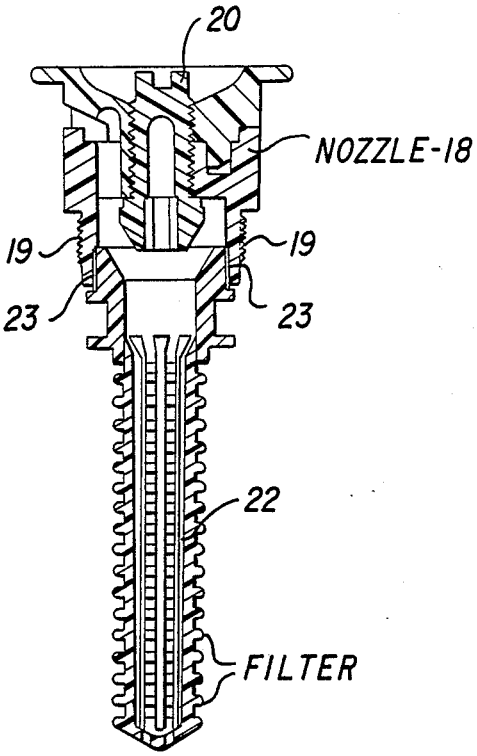
FIG. 3 is a side section of the nozzle of the sprinkler of FIGS. 1 and 2, and showing a filter removably attached to the lower end of the nozzle.

In the embodiment of FIG. 3, the head of an elongated filter 22 is removably received in the sleeve-like base of nozzle 18. Longitudinal ribs 23 are provided around the head of the filter to assure that the filter will be held by the nozzle when the nozzle is removed from the riser in a friction fit relationship. Elongated filter 22 is a rigid body formed, for example, of appropriate plastic material. The size of the pores in the filter are small enough effectively to capture any particulate matter of a size larger enough to clog or jam the orifices "O" of the nozzle 18.

An adjustment screw 20 is threaded coaxially into the nozzle 18 to adjust the water flow rate through the nozzle and the pattern radius of the water emitted by the orifices "O" of nozzle 18. The head of filter 22 provides an orifice with a conical seat for the adjustment screw 20.

Figure 4:
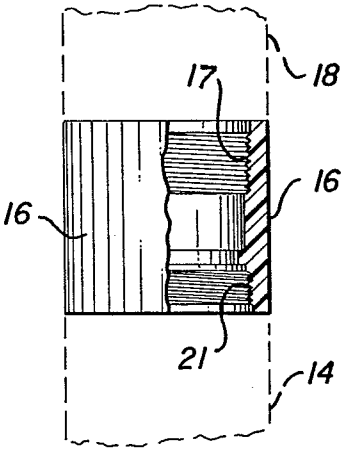
FIG. 4 is a side view, partially in section, of an adapter which is interposed between the nozzle of the sprinkler and the riser.

The nozzle 18 has male threads 19 at its base which receive female threads 17 at the top of adapter 16 which, as shown in FIG. 4, has a tubular configuration. The filter 22 fits into adapter 16 in coaxial relationship with the adapter. Adapter 16 has female threads 21 in its base which are received by male threads 15 (FIG. 2) at the top of the riser 14.

When the nozzle 18 is removed from the assembly, for example, during the installation of the system, as described above, the filter 22 is removed with the nozzle, because it is attached to the lower end of the nozzle in a friction fit, as described above.

Figure 6:
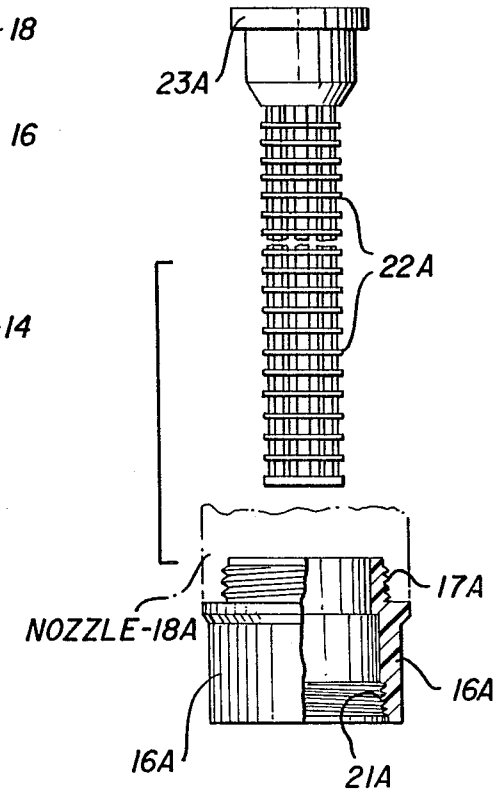
FIG. 6 is a detached view of a second type of adapter, shown partially in section, and a second type of filter which may be mounted on the riser of the sprinkler between the riser and the nozzle.

The assembly of FIG. 6 is intended to be used in conjunction with a different type of nozzle designated 18A, and shown by broken lines. Nozzle 18A has female threads at its base. An adapter 16A is provided having male threads 17A at its upper end which receive the female threads of the nozzle 18A. Adapter 16A has female threads 21A at its base which receive the male threads 15 (FIG. 2) of riser 14.

In the embodiment of FIG. 6, a filter 22A is provided whose head has a rim 23A. The head of filter 22A also provides an orifice and a conical seat for screw 20, as was the case with the embodiment of FIG. 3. In the embodiment of FIG. 6, the filter 22A is inserted through adapter 16A from its upper end, and the rim 23A extends across the top edge of the adapter. Then, when the adapter is threaded into the nozzle 18A, the filter 22A is trapped between the nozzle and the adapter. Accordingly, when the nozzle and adapter are removed from the riser, the filter 22A is also removed.

The invention provides, therefore, an improved pop-up irrigation sprinkler which may be manufactured efficiently and expeditiously, and which involves certain advantages and features, described above.

It will be appreciated that while particular embodiments of the invention have been shown and described, modifications may be made. It is intended in the claims to cover all modifications which come within the true spirit and scope of the invention.

We claim:

1. In a pop-up irrigation sprinkler assembly which includes: a tubular body having an opening in the lower end thereof for connection to a pressurized water source; a cover attached to the upper end of said body and having a central aperture therein; a riser mounted in said body and movable therein from a retracted position to a position in which it extends upwardly through the aperture in said cover in response to water pressure in said body; and resilient means mounted in said body for biasing said riser to its retracted position, the combination of: a nozzle removably mounted to the upper end of said riser; and an elongated filter mounted on the lower end of said nozzle to be removable from said riser with said nozzle and attached to said nozzle extending coaxially down into said riser.

2. The combination defined in claim 1, and which includes a tubular adapter interposed between said nozzle and said riser in coaxial relationship therewith and removably attached to said nozzle and to said riser.

3. The combination defined in claim 1, in which said filter includes a head dimensioned to fit into the lower end of said nozzle in frictional fit with said nozzle.

4. The combination defined in claim 2, in which said filter includes a head with a flange at the upper end thereof dimensioned to engage the upper edge of said adapter to trap the filter between the nozzle and the adapter.

5. The combination defined in claim 2, in which the lower end of said nozzle has male threads thereon, and the upper end of said riser has male threads thereon, and in which said adapter has female threads at the respective ends thereof to engage the male threads on said nozzle and riser.

6. The combination defined in claim 2, in which said nozzle has female threads at the lower end thereof and said riser has male threads at the upper ends thereof, and said adapter has male threads at the upper end thereof to engage the female threads of said nozzle, and in which said adapter has female threads at the lower end thereof to engage the male threads on said riser.

7. The combination defined in claim 1, in which the cover forms serrations around the aperture therein to prevent relatively large particles of matter from entering the space between the riser and the cover.

8. The combination defined in claim 2, and which includes an annular seal mounted at the upper end of said body, and having an annular portion extending between the upper edge of said body and the lower edge of said cover, and having an inner bore-like portion engaging the peripheral surface of said riser and said adapter, to form a seal with said riser and said adapter.

* * * * *